US005110512A

United States Patent [19]

Kwon

[11] Patent Number: 5,110,512

[45] Date of Patent: May 5, 1992

[54] ADJUSTABLE BUBBLE GENERATOR

[75] Inventor: In-Gyu Kwon, Suwon, Rep. of Korea

[73] Assignee: Samsung Electronics Co., Ltd., Suwon, Japan

[21] Appl. No.: 685,662

[22] Filed: Apr. 16, 1991

[30] Foreign Application Priority Data

Apr. 17, 1990 [KR] Rep. of Korea ..... 90-4709

[51] Int. Cl.[5] ..... B01F 3/04

[52] U.S. Cl. ..... 261/122; 4/541.5; 261/DIG. 26

[58] Field of Search ..... 261/DIG. 88, 122; 4/543

[56] References Cited

U.S. PATENT DOCUMENTS 4,048,266 9/1977 Baumann ..... 261/DIG. 88
4,101,988 7/1978 Sierant ..... 4/543
4,269,797 5/1981 Mikiya et al. ..... 261/DIG. 88
4,409,693 10/1983 Baumann ..... 4/543
4,625,715 12/1986 Bucher ..... 4/543

*Primary Examiner*—Tim Miles
*Attorney, Agent, or Firm*—Cushman, Darby & Cushman

[57] ABSTRACT

The adjustable bubble generator comprises a stationary casing having an air introduction aperture and a plurality of bubble discharge holes on the top wall; a movable casing having substantially the same outer configuration as that of the stationary one but adapted to be slidably inserted into the stationary casing; and an extensible distributor conduit contained within the stationary and movable casings so that it can be extended or retracted in response to the sliding movement of said movable casing with respect to the stationary one.

4 Claims, 3 Drawing Sheets

ADJUSTABLE BUBBLE GENERATOR

BACKGROUND OF THE INVENTION

The present invention is generally directed to bubble generators adapted for generation of bubbles in a bath tube for instance, and more particularly to an adjustable bubble generator which can be adjusted in length so as to either increase or decrease the bubble generation area, depending on the size of a particular bath tube or the user's preference.

Conventionally, a variety of bubble generators have been extensively employed in the art to generate certain size of bubbles which are known to provide ultrasonic cleansing effect as well as massage effect to the human skin.

As an examplary one, U.S. Pat. No. 4,269,797 issued to Mikiya et al. discloses a bubble generator comprising a bubble plate and an adjustor plate slidably coupled to each other, the former being provided with rows of parallel small bubble holes and the latter with rows of parallel small slots, large slots and large bubble holes. Mutual sliding between the plates allows three different modes of bubble generation at user3 s free choice.

Although such a bubble generator as cited above appears advantageous in that it permits user to choose a desired mode of bubble generation, neither reduction nor expansion in the effective bubble generation area is obtainable with this type of generator. More specifically, with the prior art bubble generator, it is required for the user either to choose a particular size of bubble generator depending on the dimension of a bath tube actually in use, or to displace the bubble generator of small size to a desired position in which the user wants to massage or ultrasonically cleanse a limited zone of his body. This prevents the user from obtaining a desired massaging or ultrasonic cleansing effect in a rather comfortable and economical manner. It would be desirable to provide an improved bubble generator which is able to overcome the problems and deficiencies stated above.

SUMMARY OF THE INVENTION

It is an object of the present invention to provide a bubble generator which is adjustable in its longitudinal dimension so as to enagle the user to regulate the bubble generation area, thereby increasing adaptability of the bubble generator to a particular size of bath tube.

Another object of the present invention is to make it possible for the user to enjoy a comfortable massaging and/or ultrasonic cleansing effect to a limited or whole portion of his body without having to be subject to cumbersome displacement of the bubble generator from a position to another on the bottom surface of a bath tube.

In accordance with the present invention, there is provided a bubble generator which comprises in combination: a stationary casing including top and bottom walls spaced apart by a pair of side walls, said top wall having an air introduction aperture and a plurality of bubble discharge holes arranged in a longitudinal direction of the bubble generator, said stationary casing being opened at its one end; a movable casing telescopically coupled to the open end of said stationary casing in a slidable manner, said movable casing including top and bottom walls spaced apart by a pair of parallel side walls, said top wall having a plurality of bubble discharge holes arranged in line with the discharge holes of said stationary casing, said movable casin being opened at its coupled end; and, at least one extensible distributor conduit contained within said stationary and movable casings and extending beneath and along said bubble discharge holes formed in the stationary and movable casings, said conduit having a plurality of distribution holes perforated along the length thereof whereby said conduit can be extended or retracted in response to the sliding movement of said movable casing with respect to said stationary casing. The above and other features of the present invention will become apparent from the following description of the preferred embodiment taken with reference to the attached drawings.

DESCRIPTION OF THE PREFERRED EMBODIMENT

Figure 1:
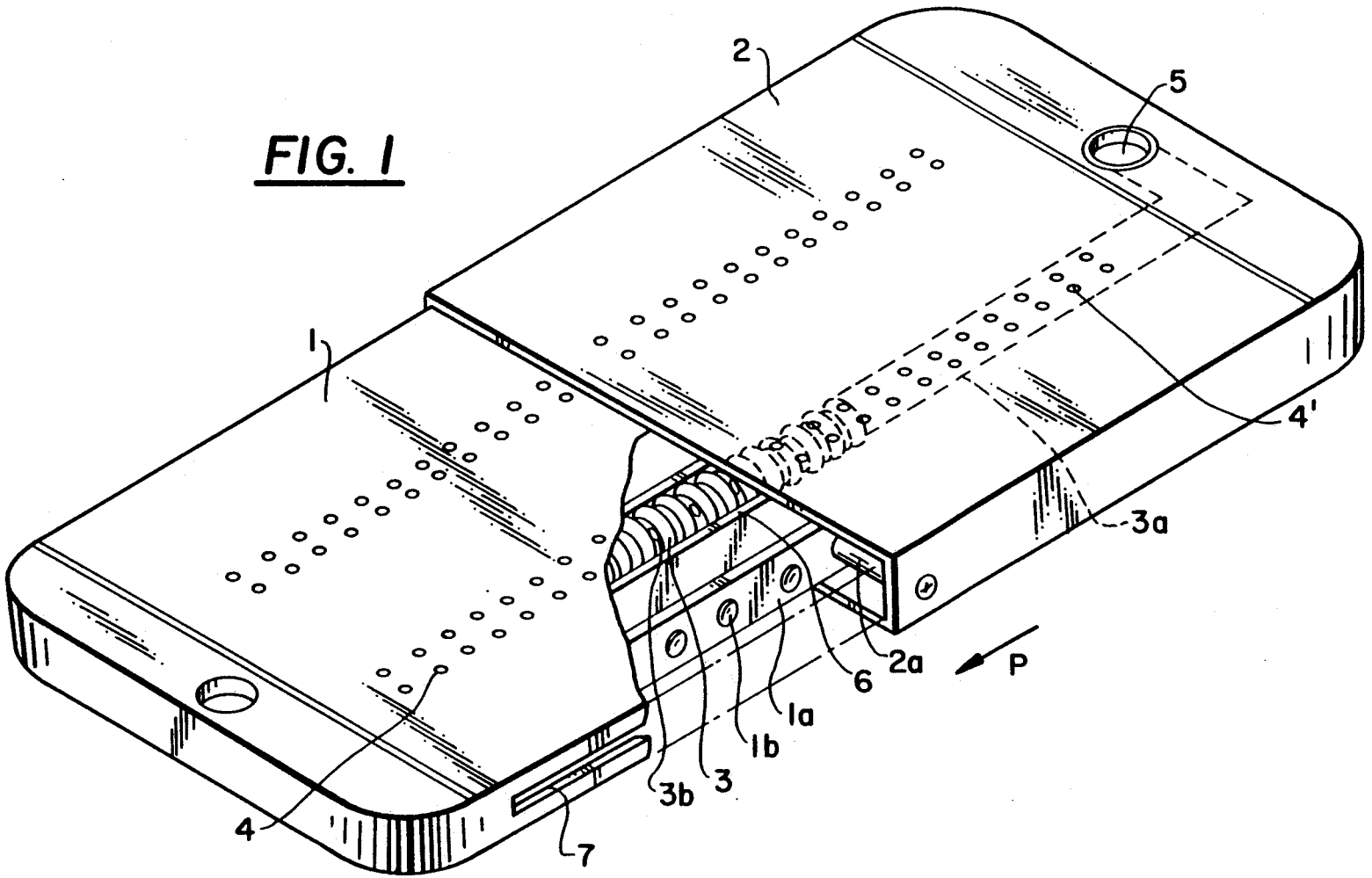
FIG. 1 is a perpective view showing an embodiment of the adjustable bubble generator in accordance with the present invention, with a portion thereof removed for clarity.
Figure 2:
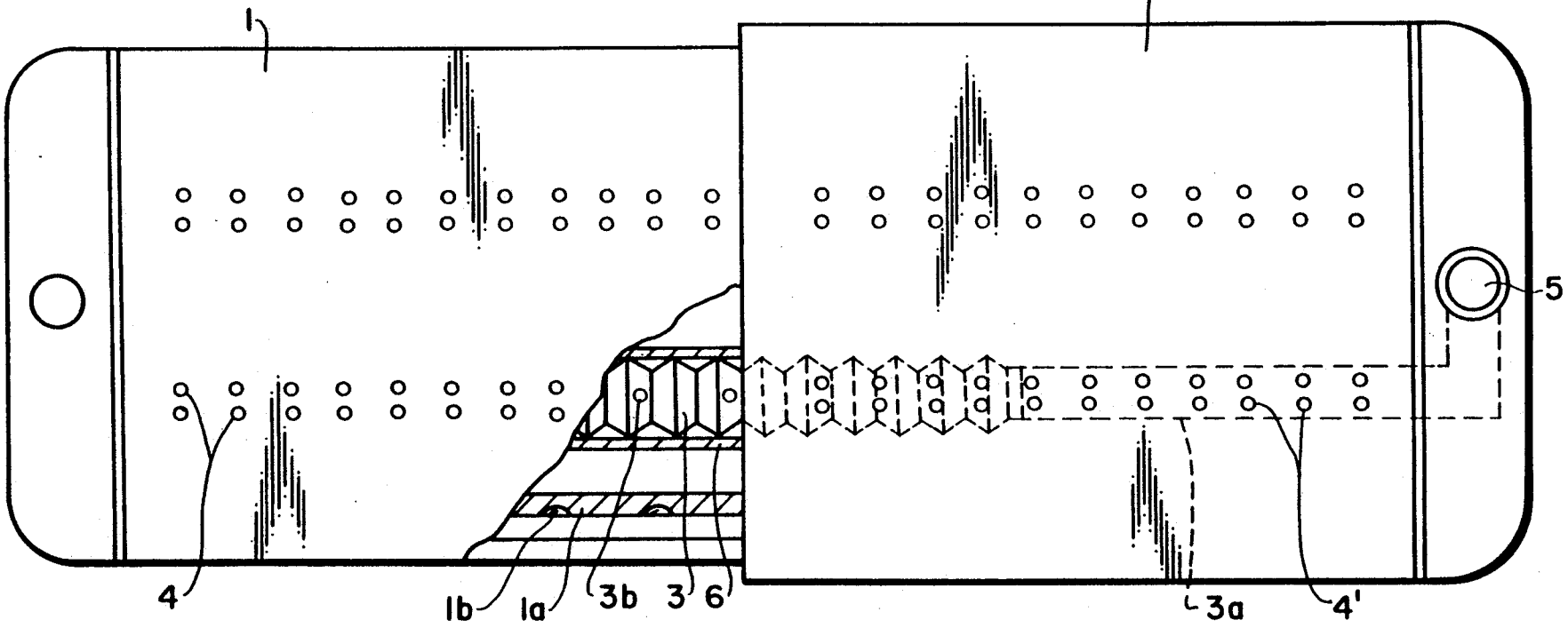
FIG. 2 is a top view of the bubble generator shown in FIG. 1 with the movable casing being in its fully extended position.
Figure 3:
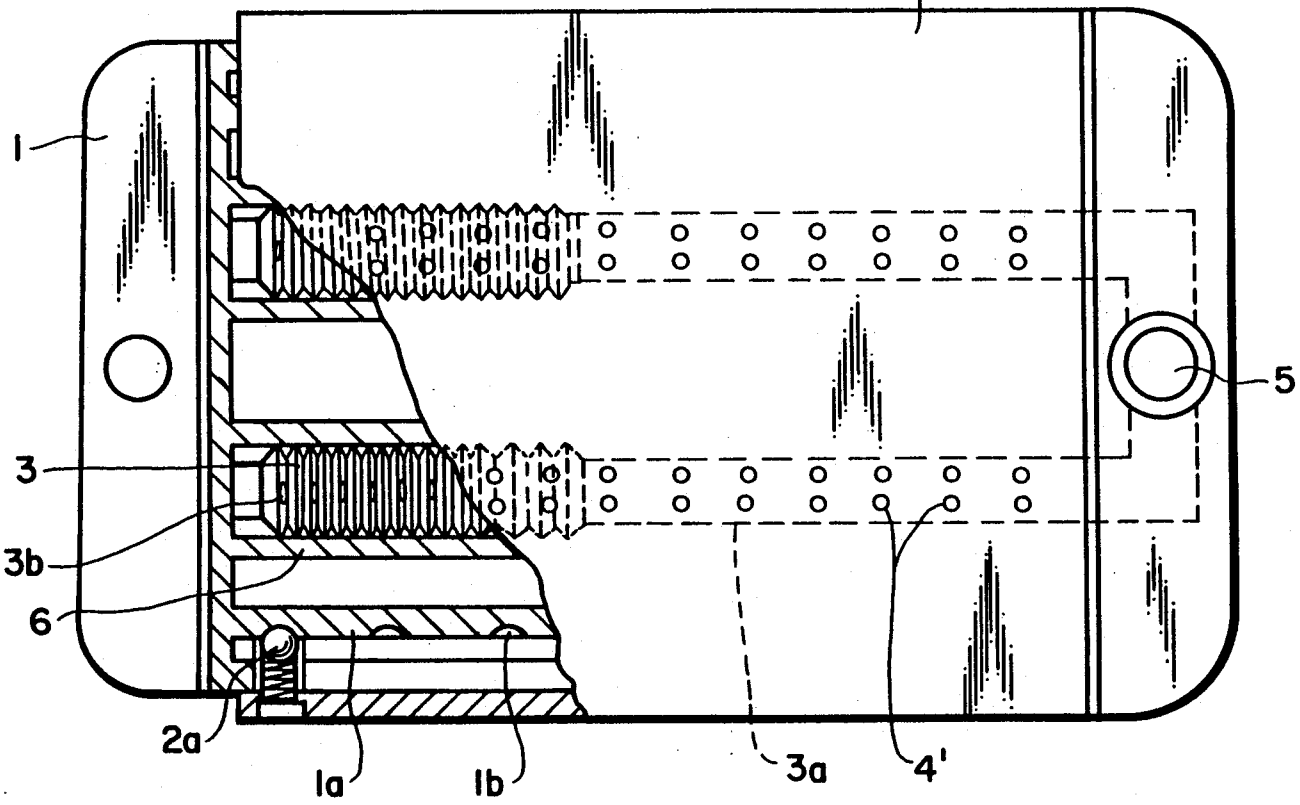
FIG. 3 is a view similar to FIG. 2 but showing the movable casing in its fully retracted position.

Referring to FIG. 1 to FIG. 3, the adjustable bubble generator comprises a stationary casing generally designated at 2, which is opened at one end and has a plurality of air discharge holes 4' equally spaced in a longitudinal direction of the bubble generator. The stationary casing 2 further includes on its top wall an air introduction aperture 5 to which is connected a supply hose (not shown) for conveying pressurized air from the air source into the stationary casing 2.

While the bubble generator in accordance with the present invention preferably has a pair of extensible distributor conduits, only one of them will be described in detail because they are almost identical in shape and size with each other.

Within the stationary casing 2, a straight portion **3*a* of the extensible distributor conduit is connected at one end to the air introduction aperture in order to distribute the introduced air through its distribution holes 3*b* and then discharge holes 4' of the stationary casing 2 in the form of air bubbles. A pin 2*a* is inwardly protruded from the side wall of the stationary casing 2, as best shown in FIG. 1**.

A movable casing 1 is telescopically coupled to the open end of the stationary casing 2 in such a manner as to enable the user to cause sliding movement of the movable casing with respect to the stationary one. The movable casing 1 is opened at the coupled end and has a plurality of air discharge holes 4 perforated on its top wall at the same interval ând direction as those of the stationary casing 2. A slot 7 extends along a predetermined length of the side wall of the movable casing 1 so as to accommodate and guide the pin **2*a* formed on the side wall of the stationary casing 2 when the stationary and movable casings are coupled to one another. Within the movable casing 1, a bellows portion 3 of the extensible distributor conduit is installed in series relationship and in fluid communication with the straight portion of the conduit 3*a* as illustrated in FIG. 3. Thus, the bellows portion 3 of the extensible conduit may be readily extended or retracted as the movable casing 1 is subjected to sliding movement with respect to the stationary casing 2. More specifically, if the user displaces the movable casing toward or away from the stationary casing, the bellows portion 3 can be extended or retracted accordingly and continue to distribute pressurized air through its distribution holes 3***b* without being broken or disconnected due to the tensile stress exerted thereon.

Further, as shown in FIG. 1, the movable casing 1 includes a bracket 1*a* having a plurality of spaced dimples 1*b* formed on the outer surface thereof. The dimple is adapted to engage with the pin 2*a* which projects inwardly from the side wall of the stationary casing 2. This enables the user to first displace the movable casing to desired position and then locate the pin 2*a* within a particular one of the dimple 1*b*, thereby preventing inadvertant relative movement between the stationary and movable casings.

As best shown in FIG. 3, the pin 2*a* formed on the side wall of the stationary casing 2 has a ball that is normally biased by means of a spring toward the bracket 1*a* of the movable casing 1. The ball will engage with specific one of the dimples 1*b* when the movable casing 1 is in a predetermined location with respect to the stationary one.

The dimples 1*b* are so pitched as to ensure coincidence of the air discharge holes 4' on the stationary casing with those on the movable casing whenever the pin 2*a* engages with any one of the dimples between the fully extended position of the bubble generator e.g., as shown in FIG. 2 and the fully retracted position, e.g., as shown in FIG. 3.

Moreover, provided within the movable casing 1 is a guide member 6 which functions to keep the extensible conduit in a normal path of movement and thereby to prevent the extensible conduit from being subject to undue flexural deformation as they are extended or retracted.

In operation of the bubble generator, if the user pulls the movable casing in the direction of arrow P as shown in FIG. 1, the extensible conduit as well as the movable casing 1 will be fully extended to a position as illustrated in FIG. 2, which would maximize the bubble generation area.

In contrast, if the user pushes the movable casing 1 toward the stationary casing 2, the movable casing 1 will be retracted to a position as shown in FIG. 2, which would minimize the bubble generation area. As stated above, the bubble generator in accordance with the present invention provides easier and more conventional regulation of the effective bubble generation area.

While the present invention has been shown and described on the basis of a particular embodiment, it should be noted that many changes and modifications may be made without departing from the scope of the invention as defined in the claims.

What is claimed is:

1. An adjustable bubble generator which comprises in combination:

a stationary casing including top and bottom walls spaced apart by a pair of side walls, said top wall having an air introduction aperture and a plurality of bubble discharge holes arranged in a longitudinal direction of the bubble generator, said stationary casing being opened at its open end;

a movable casing telescopically coupled to the open end of said stationary casing in a slidable manner, said movable casing including top and bottom walls spaced apart by a pair of parallel side walls, said top wall having a plurality of bubble discharge holes arranged in line with the discharge holes of said stationary casing, said movable casing being opened at its coupled end; and at least one extensible distributor conduit contained within said stationary and movable casings and extending beneath and along said bubble discharge holes formed in the stationary and movable casings, said conduit having a plurality of distribution holes perforated along the length thereof whereby said conduit can be extended or retracted in response to the sliding movement of said movable casing with respect to said stationary casing.

2. An adjustable bubble generator as recited in claim 1, further comprising means for guiding said conduit to avoid undue flexural deformation of said conduit as it is subjected to extension or retraction.

3. An adjustable bubble generator as recited in claim 1, futher comprising means for fixedly locating said movable casing at a desired position with respect to said stationary casing.

4. An adjustable bubble generator as recited in claim 1, wherein said stationary casing has a pin protruded inwardly from the side wall thereof, and said movable casing has a slot extending along a substantial length of the side wall whereby said pin can engage with said slot to ensure stable relative movement between said stationary and movable casings.

* * * * *